United States Patent [19]

Dahlin

[11] Patent Number: 4,503,897

[45] Date of Patent: Mar. 12, 1985

[54] TOOL FOR USE WHEN FITTING WINDOW FRAMES, DOOR FRAMES AND LIKE STRUCTURES

[76] Inventor: Ebbe T. Dahlin, Norrskensvägen 8, S-175 61 Järfälla, Sweden

[21] Appl. No.: 557,292

[22] PCT Filed: Mar. 17, 1983

[86] PCT No.: PCT/SE83/00097

§ 371 Date: Nov. 9, 1983

§ 102(e) Date: Nov. 9, 1983

[87] PCT Pub. No.: WO83/03441

PCT Pub. Date: Oct. 13, 1983

[30] Foreign Application Priority Data

Mar. 24, 1982 [SE] Sweden ..... 8201884

[51] Int. Cl.[3] ..... B25B 29/00

[52] U.S. Cl. ..... 145/1 R

[58] Field of Search ..... 145/1 R, 1 A, 1 B

[56] References Cited

U.S. PATENT DOCUMENTS 3,456,702 7/1969 Johnson ..... 145/1 R

*Primary Examiner*—James G. Smith
*Assistant Examiner*—J. T. Zatarga
*Attorney, Agent, or Firm*—Sughrue, Mion, Zinn, Macpeak and Seas

[57] ABSTRACT

A tool for use when fitting window frames and door frames and like structures into wall-openings intended therefor. The tool includes two parts, of which one is angular in shape and has a first leg (2) arranged to be secured temporarily to the inside of the wall adjacent to the opening. The second tool part has the form of an elongate, flexible but non-stretchable element (7) arranged to be permanently secured at one end to the surface of the frame facing the defining surface of the opening. The other end of the elongate element (7) and the second leg (3) of the angular tool part are arranged to be temporarily locked to one another in an adjustable fashion.

6 Claims, 5 Drawing Figures

TOOL FOR USE WHEN FITTING WINDOW FRAMES, DOOR FRAMES AND LIKE STRUCTURES

The present invention relates to a tool intended to facilitate the fitting of window frames, door frames and similar structures to wall openings intended therefor.

When fitting window and door frames into their respective openings, the frames are normally screwed into the material defining the frame-opening, as a final stage in the securing of the frame. In this respect, it is necessary that the frame is precisely fitted into the opening, before screwing the screws into the opening-defining surfaces, since, otherwise, the opening and closing functions of the window or door may be impaired. The task of placing and positioning a frame in its allotted opening is, today, both relatively time consuming and difficult, and may also be hazardous, especially when fitting windows into high-rise buildings. When fitting, for example, so-called H-windows, which when opened must be swung outwardly about a horizontal axis, it is necessary to open the window in order to fix the frame, which subjects the frame to a heavy outwardly-directed load. Neither is there any practical way of testing whether or not, for example, a window can be opened, prior to finally securing the frame in position in said opening.

In order to facilitate the work of fitting a window or door frame, it is normal in present day methods to nail into the window-frame opening a number of blocks against which the frame is subsequently pressed when fitted into the opening. The work involved in positioning and securing the blocks, however, is both tedious and relatively difficult and, as with the fitting of the frame, may also be dangerous when concerned with large frame-openings situated at high level. Moreover, it is difficult to make fine adjustments to the positions of blocks which have been finally secured.

The main object of the invention is to provide a tool which facilitates the fitting of window frames and door frames in their correct positions in a respective opening, prior to fixing the frame in said positions, while circumventing the aforementioned disadvantages, and which, inter alia enables the opening function of the window or door to be tested prior to the frame being finally secured.

These objects are achieved by means of a tool which includes a part arranged to abut the inner wall surrounding said opening, and optionally also to be temporarily secured thereto, and a part which is arranged to be secured to the frame, said tool parts being arranged to be temporarily locked one to the other.

The tool according to the invention is particularly characterized in that it comprises two parts, of which one of said parts is angular in shape, having a first leg which is arranged to be secured temporarily to the inside of the wall adjacent said opening, in that the second tool part has the form of an elongate, flexible, but not stretchable element arranged to be permanently secured at one end thereof to the surface of the frame facing the opening-defining surface; and in that the other end of the elongate element and the second leg of the angular tool part are arranged to be temporarily locked to each other.

Thus, the frame can be secured in a desired position in the opening, by securing the elongate element to the frame at various distances from the front edge of said frame.

In a preferred embodiment, the elongate element may comprise a relatively rigid metal tongue, which is provided at one end with a slot-like groove, and the said second leg of the angular tool part is provided with fixing means arranged to co-act with said slot-like groove. This embodiment enables, among other things, subsequent adjustment of the position of the frame in the opening, which adjustment may be necessary, for example, when the wall is not true.

Preferably, the aforementioned fixing means includes a screw provided with a locking knob, and the groove is provided with a recess which serves as a reference position for the screw. In this case the metal tongue may be provided with a setting scale, with said recess as a reference point. This scale may be used when fixing the locking tongue to the frame, to determine the depth at which the frame shall be fitted in the opening.

Other characterizing features of the invention will be apparent from the following claims. The invention will now be described in more detail with reference to the exemplary embodiment of a tool according to the invention illustrated in the accompanying drawings.

Figure 1:
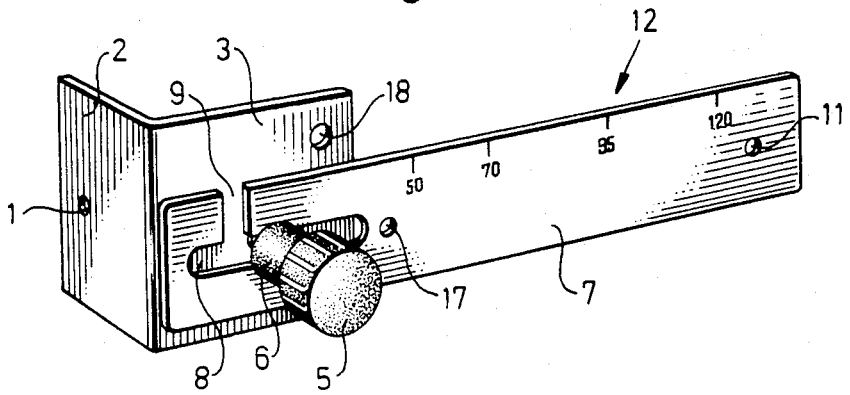
FIG. 1 is a perspective view of a tool according to the invention.
Figure 2:
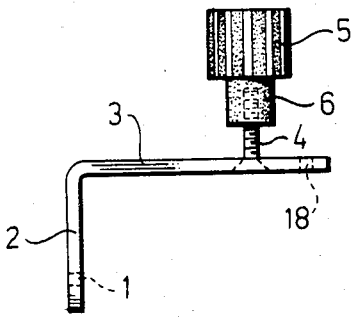
FIG. 2 is a side view of the angular part of the tool.

In the embodiment illustrated in FIGS. 1 and 2 the angular part of the tool has the form of an angle plate provided with a hole 1 in a first leg 2 of said plate, said leg being arranged to lie against the wall and to be temporarily fastened thereto by means of a nail driven through the hole 1. The second leg 3 of the angle plate is provided with a screw 4, which is screwed into a hole in said leg and which has a locking knob 5 mounted thereon. By turning the knob 5, a metal tongue 7 can be firmly pressed between the inner part 6 of the knob and the leg 3. The leg 3 may also be provided with a hole 18 through which a fastener can be driven to further secure said leg 3 in said opening.

Figure 3:
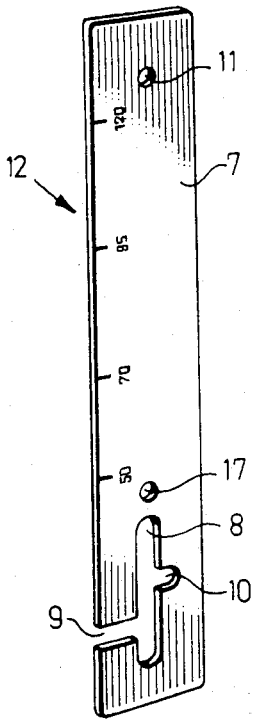
FIG. 3 illustrates the elongate element arranged to co-act with the angular tool part.

As will also be seen from FIG. 3, the metal tongue 7 is provided with a slot-like opening 8 which can be brought to co-act with the screw 4 via a slot 9. Arranged in slot-like opening 8 is a reference recess 10 in which the screw 4 is locked with the aid of the locking knob 5, when fitting the frame. As a result of the elongate form of the slot-like opening 8 it is possible to make a certain relative adjustment between the tongue 7 and the leg 3. The tongue 7 is provided with a hole 11 through which the tongue can be pivotally nailed to the frame. Along one edge of the tongue 7 there is provided a scale 12, for determining at which depth in the opening the frame is to be fitted. The recess 10 constitutes a reference point of the scale 12.

Figure 4:
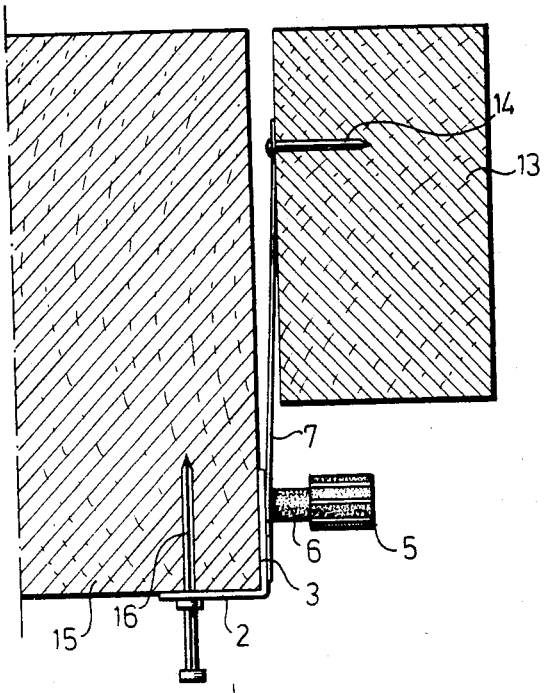
FIGS. 4 and 5 illustrate two different modes of use of a tool according to the invention.

FIG. 4 illustrates a practical way of using the tool illustrated in FIG. 1. The metal tongue 7 having first been secured to the frame 13 by means of a nail 14 driven through the hole 11. The nail 14 has been driven into the frame 13 at a distance from its forward edge such that the frame is located at the desired depth in said opening. This depth is established by reading the scale 12 on the tongue 7 at the forward edge of the frame 13. The metal tongue 7 is then secured to the leg 3 of the angular part of the tool, by means of the locking knob 5, which clamps the screw 4 in the position desired in the slot-like opening 8 in the tongue. The frame is then positioned in the opening, whereafter the metal tongue 7 is bent outwardly and the angular tool part secured with the leg 2 abutting the inside of the wall 15, by means of a nail 16 driven through the hole 1. To facilitate withdrawal of the nail, there is suitably used a nail having a double head. Suitably, the metal tongue 7 is slightly resilient, so as to conform more readily to the leg 3 and the frame 13.

By, for example, mounting two such arrangements along each of the vertical sides of the frame to be fitted, the frame can readily be fitted into an opening and provisionally secured thereto without any risk whatsoever. It can then be seen whether the window or door will open properly, and any adjustment required can then be made by displacing the metal tongue 7 relative to the screw 4, and locking the metal tongue 7 in its adjusted position. This adjustment is made easy by the fact that the metal tongue is only secured to the frame at one location thereon, thereby permitting a certain degree of pivoting movement. Consequently, all fitting work and adjustments can be done from within the room, without it being necessary to carry out any work in the opening before fitting the frame.

When the frame has been positioned correctly in the opening, and adjustment has been made so that the window or door can be readily opened, the frame is secured in a conventional manner, with the aid of penetrating screws or like fasteners. The metal tongue 7 is then released from the angular tool part and said tool part is removed from the wall, for use when fitting the next frame. The metal tongue, on the other hand, is swung into the space between the frame and the opening, where it remains. Optionally, the locking tongue may also be used for fixing the frame in the opening, in which case a nail is driven through a hole 17 in the tongue, and into the adjacent wall.

Figure 5:
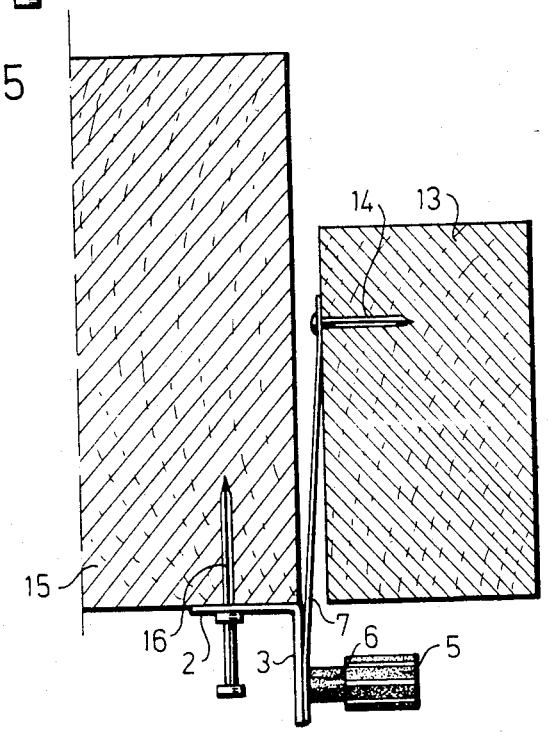

While FIG. 4 illustrates the manner in which a frame can be fitted to a given depth in an opening, FIG. 5 illustrates the manner in which a frame can be fitted flush with the inner wall of a room. The procedure is similar to that described with reference to FIG. 4, although in this case the angular part of the tool is turned in the manner shown in FIG. 5. Thus, this enables the frame to be mounted both flush with the inner wall and, if so desired, inwardly of the wall. This embodiment of the tool also provides a positive fixing of the frame in a given position in the frame opening. Thus, the same tool can be used for fitting a frame in the manner shown in FIG. 4 and in the manner shown in FIG. 5.

The invention is not restricted to the aforedescribed embodiment, which can be modified in several respects within the scope of the invention. For example, the shape and design of the element connected to the frame may be varied as desired, which also applies to the arrangement for locking the said element to the angular part of the tool. Optionally, the angular tool part may be designed so as to enable it to be swung in between the frame and the wall. Alternatively, the angular part may be arranged to be left in position and covered with a liner or the like.

I claim:

1. A tool for use when fitting window frames, door frames, and like structures to wall openings intended therefor, characterized in that the said tool includes two parts; in that one of said tool parts is angular in shape, having a first leg (2) which is arranged to be temporarily secured to the inside of the wall (15) adjacent the opening; in that the second tool part has the form of an elongate, flexible but not stretchable element (7) arranged to be permanently secured at one end thereof to the surface of the frame (13) facing the defining surface of the opening; and in that the other end of the elongate element (7) and the second leg (3) of said angular part are arranged to be temporarily locked together.

2. A tool according to claim 1, characterized in that said elongate element comprises a relatively stiff metal tongue (7), which is provided at its one end with a slot-like opening (8); and in that said second leg (3) of the angular part is provided with fixing means (4, 5, 6) arranged to co-act with said slot-like opening (8).

3. A tool according to claim 2, characterized in that said fixing means includes a screw (4) and a locking knob (5, 6) arranged to co-act with said screw; and in that the slot-like opening (8) is provided with a recess (10) which serves as a reference position for the screw (4).

4. A tool according to claim 3, characterized in that the metal tongue (7) is provided with a setting scale (12), which has said recess (10) as a reference point.

5. A tool according to any one of claims 1-4, characterized in that said slot-like opening (8) communicates with an opening slot (9).

6. A tool according to any one of claims 1-5, characterized in that said first leg (2) of the angular tool part and said one end of the elongate element (7) are provided with a hole (1; 11) for nailing the said tool part and said elongate element to the wall (15) and the frame (13), respectively.

* * * * *